US005139313A

United States Patent [19]

Fiesel et al.

[11] Patent Number: 5,139,313

[45] Date of Patent: Aug. 18, 1992

[54] GUIDES FOR MINERAL WINNING PLOUGHS

[75] Inventors: Heinz-Otto Fiesel; Christoph Rassmann, both of Lunen, Fed. Rep. of Germany

[73] Assignee: Gewerkschaft Eisenhutte Westfalia GmbH, Fed. Rep. of Germany

[21] Appl. No.: 744,373

[22] Filed: Aug. 13, 1991

[30] Foreign Application Priority Data

Aug. 16, 1990 [DE] Fed. Rep. of Germany ..... 4025826

[51] Int. Cl.[5] ..... E21C 35/12

[52] U.S. Cl. ..... 299/34; 299/43

[58] Field of Search ..... 299/34, 42, 43

[56] References Cited

U.S. PATENT DOCUMENTS 4,391,471 7/1983 Havschopp et al. ..... 299/34 X 4,474,411 10/1984 Peters et al. ..... 299/43

4,607,890 8/1986 Merten et al. ..... 299/43

*Primary Examiner*—David J. Bagnell

*Attorney, Agent, or Firm*—Samuels, Gauthier & Stevens

[57] ABSTRACT

A plough guide is composed of sections built onto the runs of channelling of a scraper chain conveyor. Behind a covering comprising covering hoods pivotable on joints, there are chain guide channels for the plough chain separated by spacers. Underneath each covering hood there is a robust guide beam which forms part of a lower guide for the plough. Each guide beam of solid rolled section is provided at each of its two ends with a recess into which is welded a stout bearing plate which on a level with the spacers. The bearing plates are equipped with open journal bearings for hinge pins positioned at the foot of the covering hood. The hinge pins are integral with hinge pieces, which are welded into recesses at the two ends of the covering hood.

14 Claims, 4 Drawing Sheets

GUIDES FOR MINERAL WINNING PLOUGHS

FIELD OF THE INVENTION

The invention relates to a guide for a mineral, e.g. coal, winning machine such as a plough.

BACKGROUND OF THE INVENTION

It is known to form a plough guide from sections composed of L-shaped angle plates with upstanding sides connected to the working face sides of the runs of channelling of a scraper-chain conveyor. The angle plates have lower walls which rest on the floor of the working to form a slide way for the plough. Sliding spacers situated a certain distance apart between an upper and a lower chain channel for a plough drive chain are connected with the upwardly extending sides of the angle plates. A covering closes off the chain channels from the face. The covering is composed of guide beams forming a lower guide for the plough and situated at a distance from the lower walls of the angle plates and covering hoods mounted in pivot joints and capable of being swung over towards the face.

Plough guides of this kind are known in a number of versions, e.g. from DE-PS 26 07 350. In these plough guides the covering hoods are pivotably mounted on the sliding spacers situated a certain distance apart, in joints situated underneath the spacers and on a level with the lower chain channel. The pivot joints are thus positioned at the foot of the cover which closes off the chain channels from the face, i.e. on the guide beam which forms the lower guide for the plough and which in this case is formed on the one hand by rolled-over parts at the foot of the covering hoods made of sheet metal and on the other hand by parts of the sliding spacers. The covering hoods have window-like recesses which the sliding spacers engage by means of pivot pins mounted on the latter. In the upper zone the covering hoods, in their closed position, are detachably connected with the top of the upwardly extending sides of the angle plates. The high covering hoods form an upper plough guide subject to considerable forces during operation of the plough. The process of manufacturing the sections of the plough guide system is very costly. An object of the invention is to provide a plough guide of this type in such a way as to ensure a simple and robust construction for the pivot joints of the hoods and at the same time to increase the stability of the system and reduce the cost of manufacture.

SUMMARY OF THE INVENTION

According to the invention there is provided a guide for mineral winning plough, comprising angle plates with upwardly extending sides which serves for connection to a working face side of runs of channelling of a scraper chain conveyor and lower walls supported on the floor and directed towards the face to form a slide way or path for a plough, sliding spacers situated a certain distance apart between an upper and a lower chain guide channel for a plough drive chain and connected with the upwardly extending sides of the angle plates and a covering which shuts off the chain channels from the face, the covering being composed of guide beams forming a lower guide for the plough and situated at a distance from that the lower walls of the angle plates and covering hoods mounted on pivot joints and capable of being swung over towards the face to open the guide channels. The guide beams are solid sectional bars each provided at each of its ends with a recess which extends from its top over only part of the height of its profile and into which is welded a bearing plate which is equipped on a level with the spacers with an open pivot bearing for a hinge pin provided on the end of the associated covering hood.

Each covering hood is preferably provided at its two ends with welded-on hinge pieces fitted with integral hinge pins. The bearing plates and/or the hinge pieces advantageously consist of robust drop forgings.

In this version of the plough guide the pivot joints for each covering hood are situated, approximately on a level with the sliding spacers, on the ends of the robust guide beam which preferably consists of a solid section rolled iron bar and which forms the lower guide for the plough and by which the high plough forces are dispersed via the sliding spacers towards the angle plates and via this latter towards the runs of channelling of the scraper chain conveyor. The strong guide beam is thus the support for the bearing plates which form the pivot joints and which are welded into the guide beam, i.e. in the end recesses of the latter, being adequately supported at their feet and on their side surface, thus providing a firm assembly of the bearing plates and the strong guide beam and ensuring sufficiently strong joints for the covering hood.

Each guide beam consisting of solid material is advantageously thickened, approximately in the shape of a club, from the top to the bottom of its profile. It is preferably made of a rolled section of highly wearresisting material. The hinge pieces are advantageously welded into end recesses of the covering hood. This latter is preferably provided at the top with a contact bar to which it can be detachably affixed, preferably with screws, to a guide bar at the top of the vertical side of the associated angle plate.

The use of a solid guide beam preferably consisting of a rolled section, on the one hand, and the arrangement of the bearing plates forming the pivot joints in the end recesses of the guide beam, on the other, renders the plough guide comparatively simple from the point of view of manufacturing and at the same time very robust. From this point of view it is also of advantage for the guide beam to have a flat rear surface by which it is connected, preferably by welding, with the sliding spacers, in such a way as to rest laterally against them. This ensures a rigid assembly of the guide beam with the strong sliding spacers and, via these latter, with the angle plates. The pivot joints are situated in the plane of the sliding spacers, which are thus positioned in the end zones of the plough guide sections. The guide beam, by its ends situated underneath the recesses, can extend beyond the welded-in bearing plates, towards the joint between the adjacent sections of the guide, so that with a comparatively moderate overall width for the bearing plates sufficiently wide and strong hinge pieces can be provided on the ends of the covering hood.

It is possible to design the bearing plates in such a way that they project beyond the rear surface of the guide beam and rest by their projecting lateral surfaces against the end surfaces of the sliding spacers, in which case they can be welded to the latter. On the other hand, however, contact pieces can also be provided behind the bearing plates situated in the recesses of the guide beam and these pieces can be connected with the guide beam and/or the sliding spacers by welding. Each contact piece provides a stop serving to limit the angle by which the associated covering hood can be opened up on its pivots, and in this case the hinge pieces are also provided with a counter-stops at the bottom of their hinge pins.

In a further advantageous feature of the invention the sliding spacers bearing the guide beam are connected with the angle plates via robust centering pins. This enables the guide beam, and at the same time the bearing plates belonging to the pivot joints and situated on it, to be accurately centered, the guide system being also rendered still firmer by connections of the tenon-dowel type.

In the preferred version the centering pins are situated on robust fitting plates which are connected, preferably by welding, with the upwardly extending sides of the angle plates. In this case the guide beam, the sliding spacers and the centering or fitting plates can be assembled to form a single all-welded component, the centering plates then being provided with the centering pins, which engage centering apertures on the vertical sides of the angle plates.

The invention may be understood more readily and various other aspects and features of the invention may become more apparent from consideration of the following description.

DESCRIPTION OF PREFERRED EMBODIMENT

Figure 1:
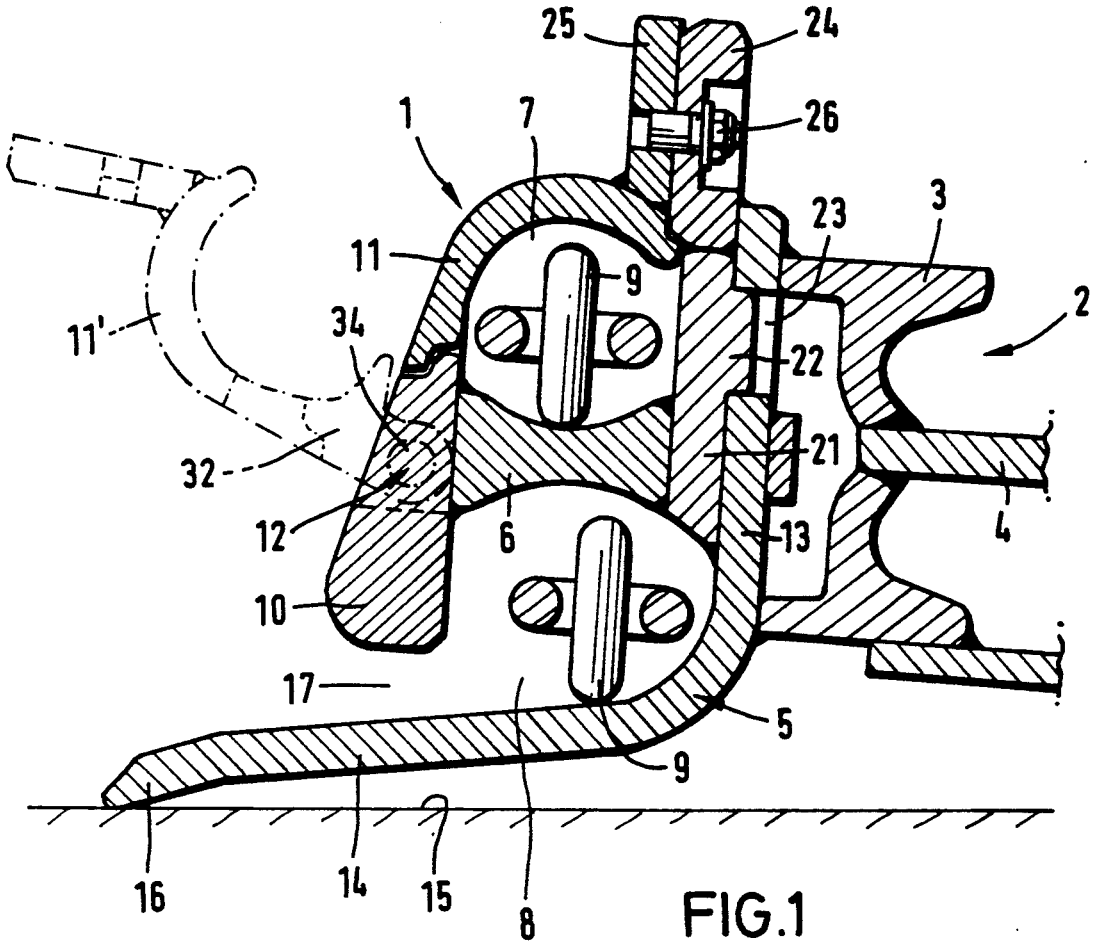
FIG. 1 is a vertical section through a guide constructed in accordance with the invention.

The guide illustrated in the drawings consists in the known manner of individual sections 1 which are built onto the runs of channelling 2 of a scraper chain conveyor on the working face side of the latter. Of the runs of channelling 2, FIG. 2 only shows the side walls 3 which are situated on the working face side and to which the conveyor floor 4 is welded.

The guide sections 1 consist of an angle plate 5, sliding spacers 6, which separate an upper guide channel 7 from a lower guide channel 8 for the plough drive chain 9, and a covering which shuts off the guide channels 7 and 8 from the working face and which is formed by a lower guide beam 10 and a covering hood 11 situated above it and closing the upper chain channel 7. The covering hood 11 is pivotably mounted in joints 12 on the guide beam 10, and the joints 12 are situated on a level with the spacers 6. The angle plate 5 the guide beam 10 and the covering hood 11 extend, on each plough guide section 1 over approximately the entire length of the run of channelling 2. Each angle plate 5 is connected by its upwardly extending side 13 with the run of channelling 2 in such a way as to rest laterally against the side wall 3 of the latter. The connection between the sections 1 and the runs of channelling can be, by welding, although screwthreaded connections of the known kind or other types of connection can be adopted. A lower wall portion 14 of the angle plate 5 which points towards the working face is slightly inclined in relation to the floor 15 and rests on the latter by its front edge 16. The guide beam 10 partly covers the lower chain channel 8 and, together with the wall 14 of the angle plate 5 forms a lower guide region for the plough. The plough has one or more guide blocks which pass through a gap 17 between the guide beam 10 and the wall 14 and connect with the chain in the chain channel 8. The guide beam 10 with the sliding spacers 6 is shown separately in FIG. 2 to 4. The solid guide beam 10 preferably consisting of rolled section iron, is shaped in such a way as to increase in thickness, approximately in the shape of a club, from the top 18 to the bottom 19 of its profile. The robust guide beam 10 has a flat rear surface 20, by which it is connected, preferably by welding, with the two sliding spacers 6, in such a way as to rest laterally against them. Each plough guide section 1 has an associated two sliding spacers 6, which are situated at a certain distance apart in the two end zones of the guide beam 10. The spacers 6 are connected at their other ends, preferably by welding, with robust centering plates 21 which extend upwards over the sliding spacers 6 (FIG. 3 and 4) and form the inner side boundary of the upper chain channel 7 (FIG. 1). The centering plates 21 preferably consist of drop forgings. The plates 21 are in each case provided with two forged centering pins 22 which, as may be seen from FIG. 1, engage centering apertures 23 in the upwardly extending side 13 of the angle plate 5 and thus centre the sliding spacers 6 and also the guide beam 10, in relation to the angle plate 5. At the same time the centering pins 22 ensure a robust joint between the parts 6 and 5, improving the strength of the plough guide. In the example shown in FIG. 1 each centering plate 21 is welded to the upwardly extending side 13 of the angle plate 5. At the same time the sliding spacers 6 are welded to the centering plate 21 and the guide beam 10. The beam 10, the sliding spacers 6, the centering plates 21 and the angle plate 5 of each guide section 1 thus form a unitary all-welded structure which is connected up to the run of channelling 2, as mentioned previously by either welding, a screw connection or some other means. In place of this, however, the sliding spacers 6 likewise can be combined with the guide beam 10 and the centering plates 21 to form a welded part, which is connected by screws to the angle plate 5 or to its side 13 and via this latter with the side wall 3 of the run of channelling 2.

A strong guide bar 24 is welded to the top of the vertical side 13 of each angle plate 5, above the centering plates 21. The bar 24 extends above the scraper chain conveyor and forms an upper guide region for the plough. In the closed position the covering hood 11 rests by a contact bar 25, welded to its top part, against the guide bar 24, with which it is detachably connected by means of a screw connection 26. After the screw connection 26 has been released the covering hood 11 can be moved on the joints 12 into the open position 11 which is shown in dot-and-dash lines in FIG. 1 and in which the upper chain channel 7 is opened and the lower chain channel 8 is accessible via the latter.

Figure 2:
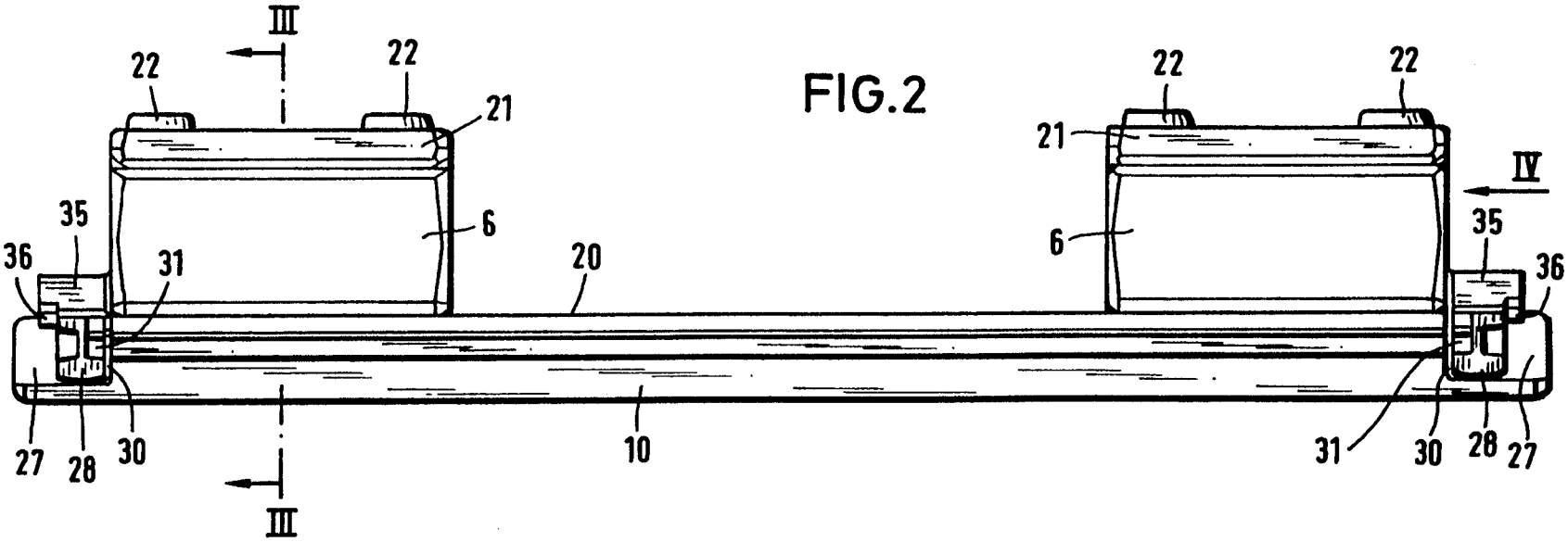
FIG. 2 is a plan view of the guide shown in FIG. 1.
Figure 3:
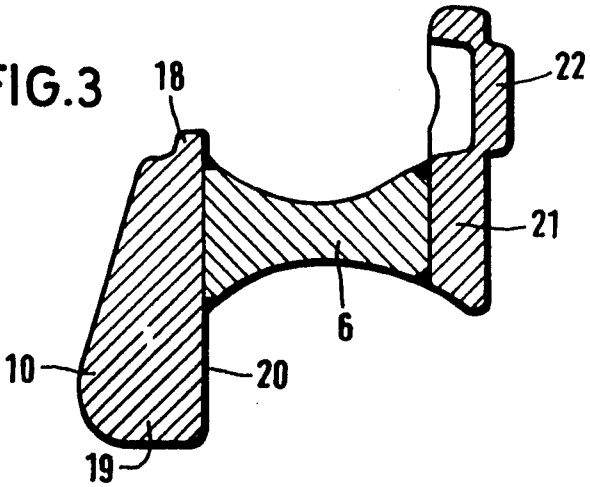
FIG. 3 is a vertical section taken along line III—III of FIG. 2.

As may be seen particularly from FIG. 2, the guide beam 10 is provided at each of its two ends with a recess 27 which extends from its top part 18 over only a portion of its height, i.e. approximately as far as the bottom of the sliding spacer 6 and into which is welded a bearing plate 28 for one of the pivot joints 12. The bearing plates 28 rest by their bottom surfaces 29 on the bases of the recesses 27 and by their side surfaces 30 (FIG. 8) against those of the recesses 27 of the guide beam 10.

Figure 4:
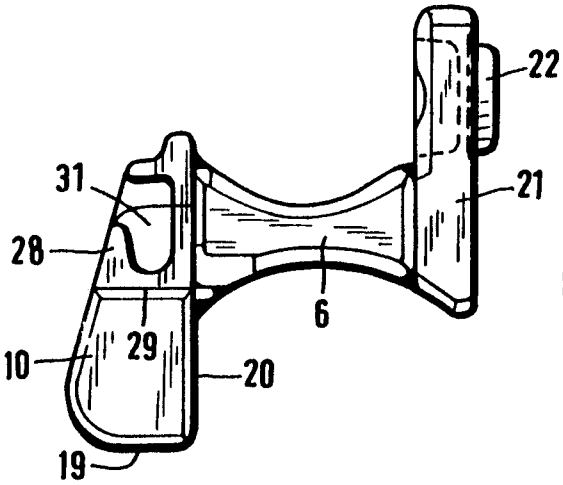
FIG. 4 is an end view taken in the direction shown by the arrow IV in FIG. 2.
Figure 5:
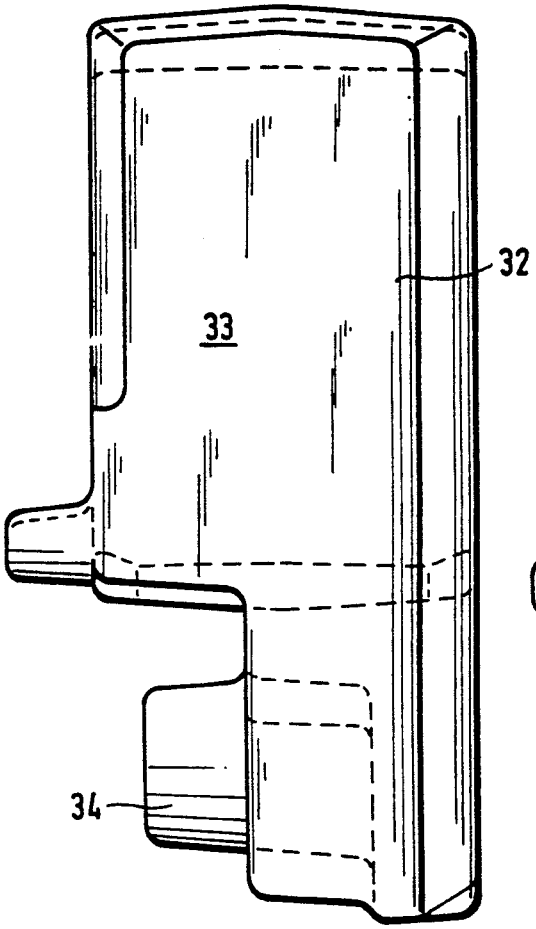
FIG. 5 depicts a component of the guide hood, as viewed from the working face.
Figure 6:
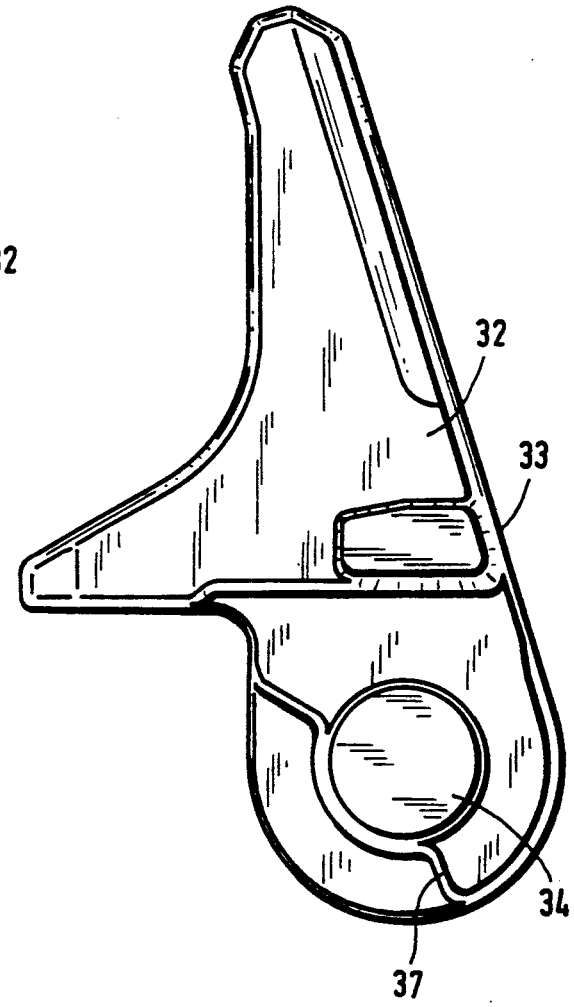
FIG. 6 is a side view of the component shown in FIG. 5.
Figure 7:
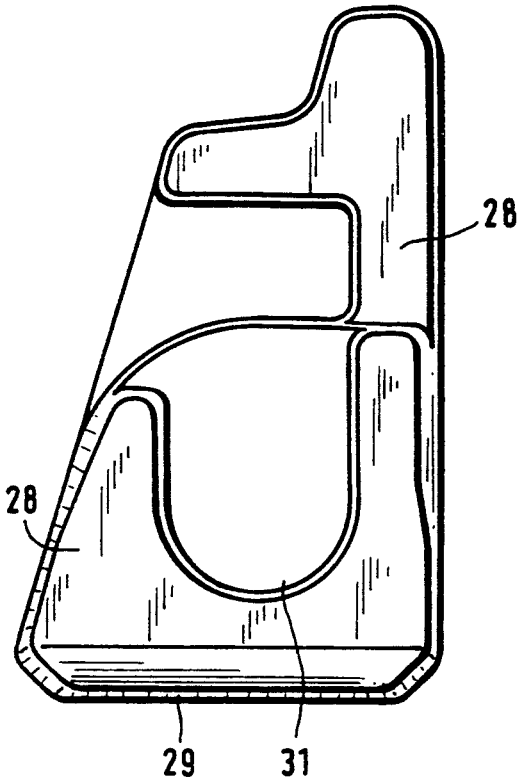
FIG. 7 depicts another component of the guide beam.
Figure 8:
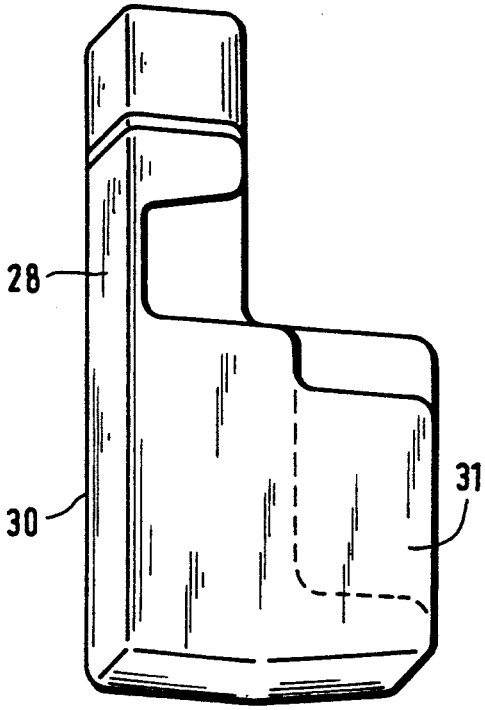
FIG. 8 is a perspective view of the component of FIG. 7, as viewed from the working face.

As may be seen in particular from FIG. 4, 7 and 8, the bearing plates 28 each provide an open journal bearing 31 for a hinge pin provided on one of the ends of the covering hood 11. FIG. 2 also shows that the guide beam 10, by its ends situated underneath the two recesses 27, extends beyond the welded-in bearing plates 28 towards the joint between the sections 1 of the guide. The bearing plates 28 preferably consist of drop forgings. The same applies to associated hinge pieces 32, which are situated on the two ends of the covering hood 11 and welded into recesses of the hood 11. FIGS. 5 and 6 show a single hinge piece 32 of which the surface 33 nearer to the face is situated in the plane of the covering hood 11. A hinge pin 34 is shaped onto the bottom part of the hinge piece 32. When the covering hood 11 is being mounted it is suspended from the working-face side by the hinge pins 34 of its two hinge pieces 32 into the open journal bearings 31 of the bearing plates 28 of the guide beam 10. The covering hood 11 can then be moved over on the two joints 12 into the closed position shown in FIG. 1 and secured in the said position by means of the screw connection 26.

FIG. 2 also shows that behind the two bearing plates 28 contact pieces 35 are provided which likewise preferable consist of drop forgings. The contact pieces 35 are rigidly connected to the guide beam 10 and/or the sliding spacers 6 by welding. The contact pieces 35 are positioned behind the bearing plates 28 outside the recesses 27. The contact pieces 35 each have a stop 36 which engages the recess 27 and is formed by a lug 36 or the like which delimits the pivoting movement of the covering hood 11 in the open position indicated at 11' in FIG. 1. For this purpose the hinge pieces 32 of the covering hood 11 are each provided, at the bottom of each their pin 34, with a counter-stop 37, formed by a surface approximately radial to the hinge pin 34. When the covering hood 11 occupies the open position it rests by its counter-stop 37 against the stop 36 of the contact piece 35. In FIG. 4 the contact piece 35 is not shown.

I claim:

1. In a plough guide for a mineral winning plough, comprising angle plates with upwardly extending sides which serve for connection to a working face side of runs of channelling of a scraper chain conveyor and lower walls supported on the floor and directed towards the face to form a slide path for a plough, sliding spacers situated a certain distance apart between an upper and a lower chain guide channel for a plough drive chain and connected with the upwardly extending sides of the angle plates and a covering which shuts off the chain channels from the face, the covering being composed of guide beams forming a lower guide for the plough and situated at a distance from that the lower walls of the angle plates and covering hoods mounted on pivot joints and capable of being swung over towards the face to open the guide channels; the improvement comprising the guide beams are solid sectional bars each provided at each of its ends with a recess which extends from its top over only part of the height of tis profile and into which is welded a bearing plate which is equipped on a level with the spacers with an open pivot bearing for a hinge pin provided on the end of the associated covering hood.

2. A plough guide according to claim 1, whereas each covering hood is provided at its two ends with welded-on hinge pieces fitted with integral hinge pins for location in the bearings.

3. A plough guide according to claim 2 whrein the hinge pieces consist of drop forgings.

4. A plough guide according to claim 2, wherein the hinge pieces are welded into recesses of the covering hood.

5. A plough guide according to claim 1, wherein each guide beam is a rolled section which increases in thickness, approximately in the shape of a club, from its top to its base.

6. A plough guide according to claim 1, wherein each of the guide beams has a smooth rear surface with which it is connected to the associated spacers, in such a way that it rests flatly thereagainst.

7. A plough guide according to claims 1, wherein the bearing plates project beyond the rear surface of the associated guide beam and rest by their projecting side surfaces against the end surfaces of the associated spacers.

8. A plough guide according to claim 1, wherein behind the bearing plates there are contact pieces connected by welding with the associated guide beam and/or the spacers, each contact piece being equipped with a stop for delimiting the distance by which the associated covering hood can be opened up on its pivot joints with hinge pieces being provided, at the bottom of their hinge pins with associated counter-stops.

9. A plough guide according to claim 1, wherein each guide beam, by its ends situated underneath the recesses, extends over the welded-in bearing plates and towards a joint between adjacent sections of the guide.

10. A plough guide according to claim 1, wherein the spacers bearing the guide beams are connected to the angle plates via centering pins.

11. A plough guide according to claim 10 wherein the centering pins are positioned on centering plates which are connected to the sliding spacers by welding.

12. A plough guide according to claim 11, wherein each guide beam with the associated spacers and centering plates are combined to form a unitary welded component, in which the centering plates resting flatly against the upwardly extending side of one of the angle plates with the centering pins engaging in centering apertures in said side.

13. A plough guide according to claim 1, wherein the bearing plates consist of drop forgings.

14. A plough guide according to claim 1, wherein the top part of each covering hood bears a contact bar with which it is detachably connected to a guide bar on the top of the upwardly extending side of the associated angle plate.

* * * * *